US005589925A

United States Patent [19]

Cahill

[11] Patent Number: 5,589,925

[45] Date of Patent: Dec. 31, 1996

[54] ANTI-GOUGING SKIVE MECHANISM WITH REPLACEABLE FINGERS

[75] Inventor: David F. Cahill, Rochester, N.Y.

[73] Assignee: Eastman Kodak Company, Rochester, N.Y.

[21] Appl. No.: 335,927

[22] Filed: Nov. 8, 1994

[51] Int. Cl.[6] ..... G03G 21/00

[52] U.S. Cl. ..... 399/323; 271/307

[58] Field of Search ..... 355/282, 284, 355/315, 308, 309; 271/307, 311, 289–290, 312, 313, 900; 219/216, 469

[56] References Cited

U.S. PATENT DOCUMENTS

| | | | |
|---|---|---|---|
| 3,846,151 | 11/1974 | Roteman et al. | 117/21 |
| 3,973,844 | 8/1976 | McCarroll . | |
| 3,986,227 | 10/1976 | Fathergill et al. | 15/256.53 |
| 4,149,797 | 4/1979 | Imperial . | |
| 4,165,965 | 8/1979 | Bernardelli et al. | 432/75 |
| 4,357,094 | 11/1982 | Zepko . | |
| 4,384,781 | 5/1983 | Takada . | |
| 4,421,401 | 12/1983 | Kagiura et al. . | |
| 4,475,804 | 10/1984 | Kanno et al. . | |
| 4,571,054 | 2/1986 | Bowler, Jr. . | |
| 4,571,056 | 2/1986 | Tani et al. . | |
| 4,737,818 | 4/1988 | Tanaka et al. . | |
| 4,755,848 | 7/1988 | Tamary . | |
| 4,771,310 | 9/1988 | Leo et al. | 271/311 |
| 4,929,983 | 5/1990 | Barton et al. | 355/315 |
| 5,047,809 | 9/1991 | Owada et al. | 355/284 |
| 5,160,130 | 11/1992 | Fromm et al. | 271/307 |
| 5,272,509 | 12/1993 | Pitts et al. | 355/284 |

FOREIGN PATENT DOCUMENTS

| | | | |
|---|---|---|---|
| 0363129 | 4/1990 | European Pat. Off. | 355/315 |
| 0111872 | 5/1991 | Japan | 355/315 |

*Primary Examiner*—Thu Anh Dang
*Attorney, Agent, or Firm*—Lawrence P. Kessler

[57] ABSTRACT

At least one simplified skive member for a skive mechanism for stripping a receiver member adhering to a fuser assembly roller. The simplified skive member includes an elongated, relatively flexible skive finger. The skive finger is readily releasably received in a support body so as to support a major portion of the skive finger to increase the rigidity thereof. Particularly, the support body has a first ledge upon which a skive finger can be slidably received, a second ledge opposite to the first ledge to retain a skive finger therebetween, a stop member to limit the distance to which the skive finger can slide along the first ledge, and a locking feature for preventing the skive finger, after engagement with the stop member, from moving in a direction opposite such sliding direction.

6 Claims, 5 Drawing Sheets

ANTI-GOUGING SKIVE MECHANISM WITH REPLACEABLE FINGERS

RELATED APPLICATION

U.S. patent application Ser. No. 08/335,933, filed Nov. 8, 1994, in the name of David F. Cahill, now U.S. Pat. No. 5,532,810.

BACKGROUND OF THE INVENTION

The present invention relates in general to a skive mechanism for stripping receiver members from fuser assembly rollers of reproduction apparatus and, more particularly, to a fuser assembly roller skive mechanism, substantially preventing damage to the skive fingers of the skive mechanism or gouging of the surface of the rollers by the skive fingers, having readily replaceable skive fingers.

In typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser assembly at a downstream location. There the image is fixed to the receiver member by heat and/or pressure from the fuser assembly to form a permanent reproduction thereon.

One type of fuser assembly, utilized in typical reproduction apparatus, includes at least one heated roller and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

It sometimes happens that the marking particles stick to the peripheral surface of the heated roller and result in the receiver member adhering to such roller; or the marking particles may stick to the heated roller and subsequently transfer to the peripheral surface of the pressure roller, resulting in the receiver member adhering to the pressure roller. Therefore, a skive mechanism including skive fingers (or separator pawls) has been employed to engage the respective peripheral surfaces of the fuser assembly rollers to strip any adhering receiver member from the rollers in order to substantially prevent receiver member jams in the fuser assembly.

Typically, a fuser assembly skive mechanism includes a plurality of skive fingers. The skive fingers are generally formed as elongated members respectively having a relatively sharp leading edge urged into engagement with a fuser assembly roller. For example, the skive fingers may be thin, relatively flexible, metal shim stock. The respective leading edge of each of the skive fingers is directed in the opposite direction to rotation of the fuser assembly roller with which such skive finger is associated so as to act like a chisel to strip any receiver member adhering to such roller from the peripheral surface thereof. However, if the marking particle image is particularly heavy, the receiver member may adhere to a fuser assembly roller with such force that engagement with the skive fingers does not completely strip the receiver member from the roller.

When a receiver member transported through the fuser assembly is only stripped from a roller by some of the skive fingers (and not by others), the receiver member will cause a jam in the fuser assembly. This destroys the reproduction formed on the receiver member and shuts down the reproduction apparatus. Moreover, as the receiver member moves with the fuser assembly roller to which it adheres, the stripped portions of the receiver member are forced into engagement with their associated skive fingers by the non-stripped portions of the receiver member. The engagement force of the receiver member on the skive fingers may be sufficient to flex those skive fingers so as to engage the associated peripheral surface of the fuser assembly roller at a substantially increased attack angle. This increased attack angle may then damage the roller by gouging its peripheral surface or may damage the skive finger itself. Alternatively, as the receiver member is transported through the fuser assembly, the receiver member may apply such force to the skive fingers on initial engagement therewith so as to cause such fingers to buckle in the direction which will flex those skive fingers to engage the associated fuser assembly roller at an increased attack angle. Again, this increased attack angle may damage the roller by gouging its peripheral surface or may damage the skive finger itself.

In the copending U.S. patent application Ser. No. 08/335,933, now U.S. Pat. No. 5,532,810, a skive mechanism is shown and described which comprises relatively flexible skive fingers. A major portion of the skive fingers are supported so as to increase the rigidity thereof. The skive finger support is mounted, relative to a fuser assembly roller, such that in a first position the skive fingers engage the roller with the skive finger support spaced from the roller, and in a second position the skive fingers engage the roller with the skive finger support in engagement with the roller to limit flexing of the skive fingers to substantially prevent gouging of the peripheral surface of the fuser assembly roller or damage to the skive finger. The skive finger support and associated skive finger are of complex construction and are difficult to manufacture.

SUMMARY OF THE INVENTION

In view of the foregoing discussion, this invention is directed to a simplified skive mechanism construction for stripping a receiver member adhering to a fuser assembly roller of a fuser assembly of the type having a pair of rollers in nip relation to transport a receiver member therebetween to permanently fix a marking particle image to such receiver member. The simplified skive mechanism includes at least one simplified skive member comprising an elongated, relatively flexible skive finger. The skive finger is readily releasably received in a support body so as to support a major portion of said skive finger to increase the rigidity thereof. Particularly, the support body has a first ledge upon which a skive finger can be slidably received, a second ledge opposite to the first ledge to retain a skive finger therebetween, a stop member to limit the distance to which the skive finger can slide along the first ledge, and a locking feature for preventing the skive finger, after engagement with the stop member, from moving in a direction opposite such sliding direction.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
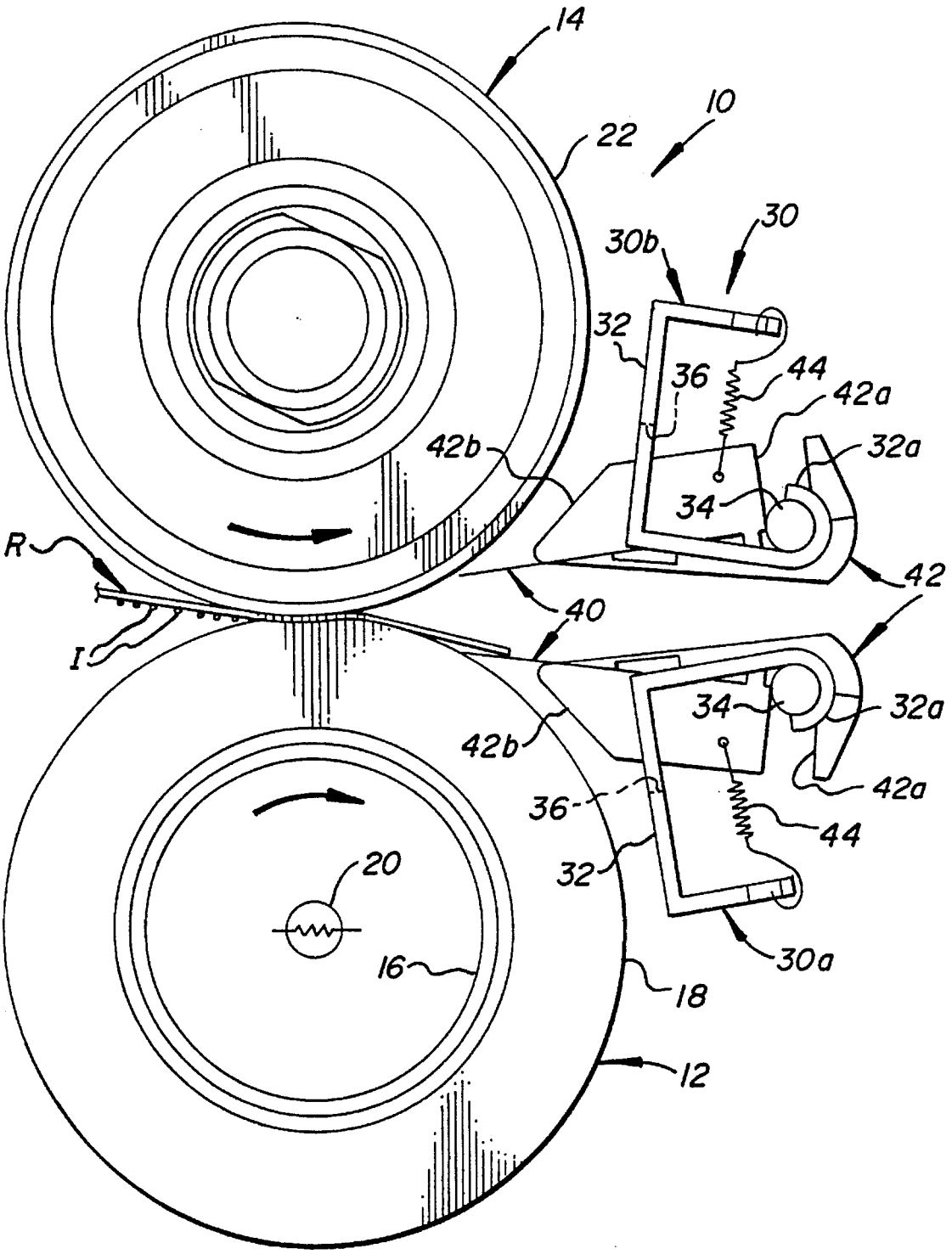
FIG. 1 is a front elevational view, partly in cross-section with portions removed to facilitate viewing, of a typical fuser assembly for a reproduction apparatus, incorporating the anti-gouging skive mechanism, including the simplified skive member according to this invention, showing the skive fingers of the skive mechanism in their normal operating position.

Referring now to the accompanying drawings, FIG. 1 shows a typical fuser assembly, for a reproduction apparatus of the electrostatographic type, designated generally by the numeral 10. The fuser assembly 10 includes a fuser roller 12 in nip relation with a pressure roller 14. Rotation of the fuser assembly rollers by any suitable drive mechanism (not shown) will serve to transport a receiver member (designated by the letter R in FIG. 1), bearing a marking particle image (designated by the letter I in FIG. 1) through the nip under the application of heat and pressure. The receiver member may be, for example, a sheet of plain bond paper or transparency material. The heat will plasticize the marking particles, and the pressure will force the particles into intimate contact and to be at least partially imbibed into the fibers at the surface of the receiver material. Thus, when the marking particles cool, they are permanently fixed to the receiver member in an imagewise fashion.

The fuser roller 12 includes a core 16 and a cylindrical fusing blanket 18 supported on the core. The blanket 18 is typically made of a rubber material particularly formulated to be heat conductive or heat insulative, dependent upon whether the fuser heat source is located within the core 16 or in juxtaposition with the periphery of the blanket. In the illustrated preferred embodiment as shown in FIG. 1, the heat source is an internal heater lamp designated by the numeral 20. A well known suitable surface coating (not shown) may be applied to the blanket 18 to substantially prevent offsetting of the marking particle image to the fuser roller 12.

The pressure roller 14 has a hard outer shell 22. Typically, the shell 22 is made of metal, such as aluminum or steel, for example. The shell 22 may also have a well known suitable surface coating (not shown) applied thereto to substantially prevent offsetting of the marking particle image to the pressure roller 12. A cleaning assembly (not shown) may be provided to remove residual marking particle, paper fibers, and dust from the fuser assembly rollers.

As noted above, under certain circumstances, such as when fusing heavy marking particle images, the receiver member may adhere to one or the other of the fuser assembly rollers (i.e., fuser roller 12 or pressure roller 14). Therefore, a skive mechanism designated generally by the numeral 30, fully shown and described in the aforementioned copending U.S. patent application Ser. No. 08/335,933, now U.S. Pat. No. 5,532,810, is provided. The skive mechanism 30, described herein to the extent necessary for a complete understanding of this invention, includes a pair of assemblies 30*a* and 30*b* respectively associated with the fuser assembly rollers 12 and 14. Since the assemblies 30*a*, 30*b* are essentially mirror images of one another, only assembly 30*a*, and its function relative to the fuser roller 12, will be fully described. It is, of course, clearly understood that the other assembly 30*b* is of substantially the same (but mirrored) construction and functions in the same manner relative to the pressure roller 14.

Figure 2:
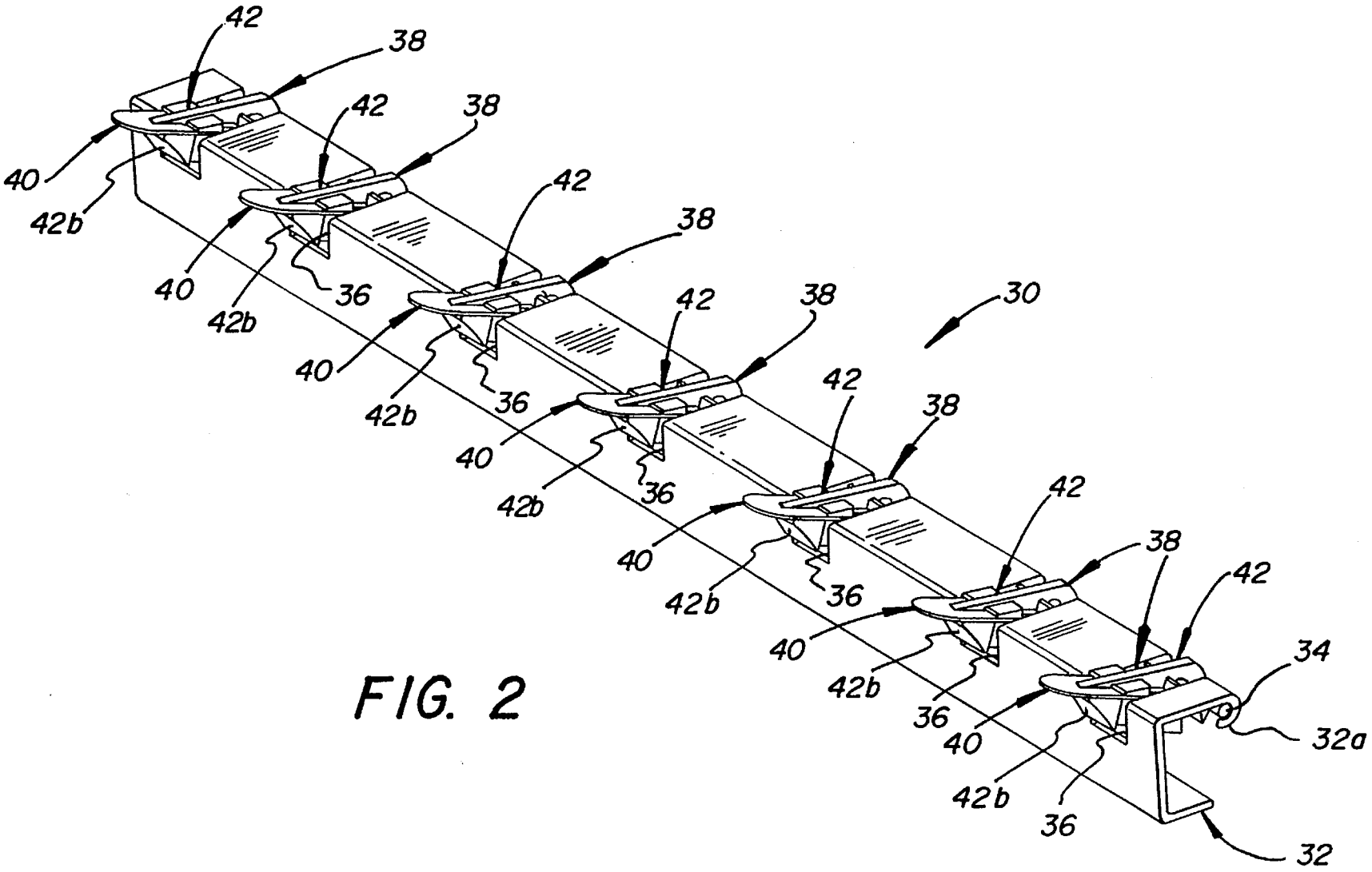
FIG. 2 is a view in perspective of an assembly for a plurality of skive members for the anti-gouging skive mechanism for use in the fuser assembly of FIG. 1.

The assembly 30*a* of the skive mechanism 30 comprises a mounting bracket 32 (best shown in FIGS. 1 and 2). The bracket 32 is supported within the frame of a reproduction apparatus, in any well known suitable manner, in a predetermined spatial relation with the fuser roller 12. The bracket has a turned marginal edge portion 32*a* which captures and supports a shaft 34. The shaft 34 extends for substantially the full longitudinal dimension of the bracket 32, and is retained such that its longitudinal axis is substantially parallel to the longitudinal axis of the fuser roller 12. Further, the bracket 32 defines a plurality of openings 36. The openings 36 are substantially uniformly spaced along the longitudinal dimension of the bracket 32.

Figure 3:
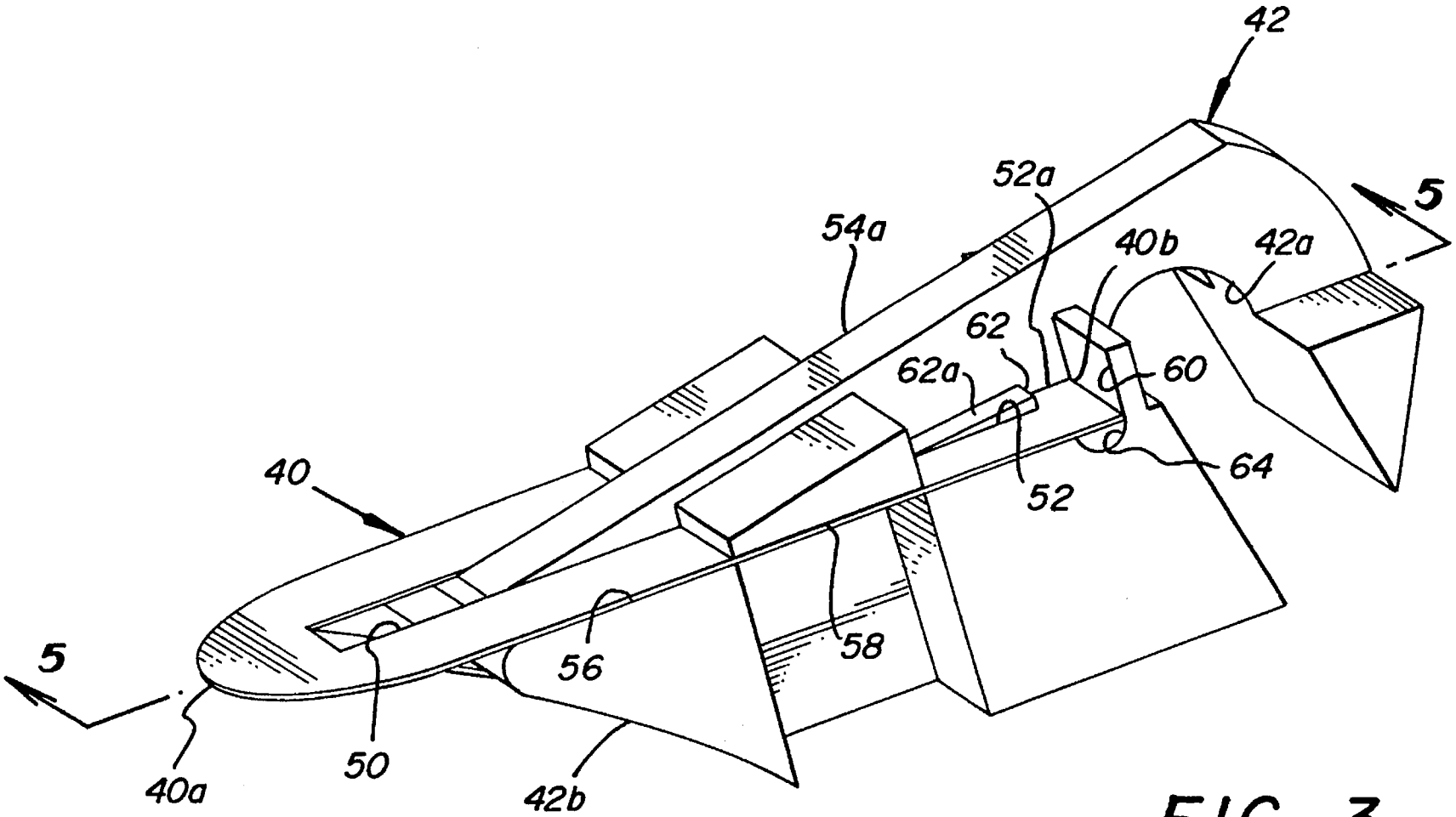
FIG. 3 is a view in perspective, on an enlarged scale, of a simplified skive member according to this invention, for the anti-gouging skive mechanism.
Figure 4:
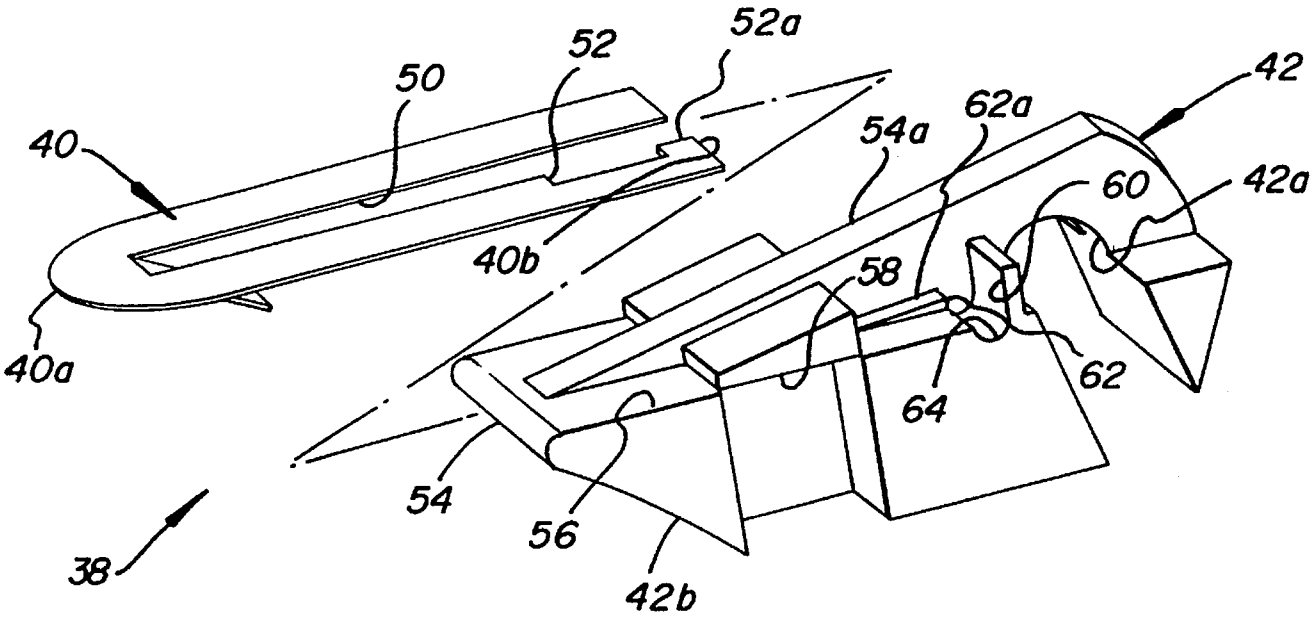
FIG. 4 is an exploded view in perspective, on an enlarged scale, of the simplified skive member shown in FIG. 3.
Figure 5:
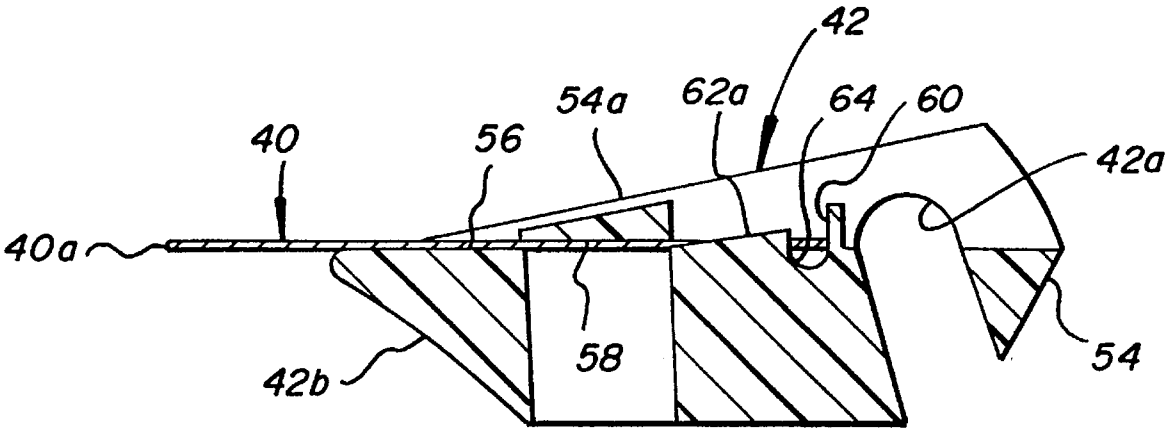
FIG. 5 is a side elevational view, in cross-section, taken along lines 5—5 of FIG. 3, of a simplified skive member for the anti-gouging skive mechanism for use in the fuser assembly of FIG. 1.
Figure 6:
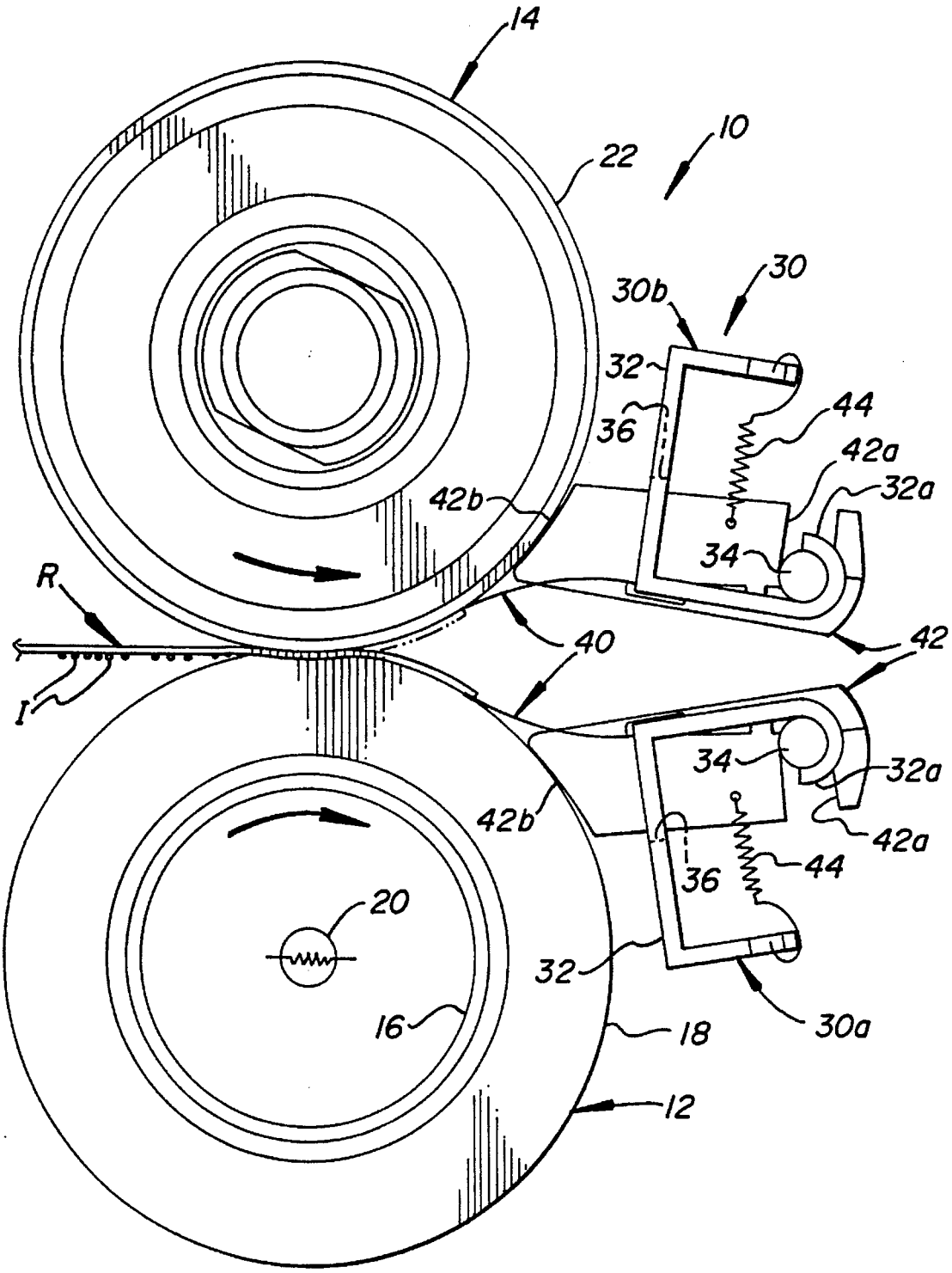
FIG. 6 is a front elevational view, similar to FIG. 1, of a typical fuser assembly for a reproduction apparatus, incorporating anti-gouging skive mechanism, including the simplified skive member according to this invention, showing the skive fingers when subjected to a receiver member adhering to a fuser assembly roller.

A plurality of simplified skive members 38, according to this invention, are associated with the plurality of openings, respectively (see FIG. 2). Each of the skive members 38 (best shown in FIGS. 3–5) comprises a skive finger 40 and a skive finger support 42. The skive finger 40 is formed as an elongated, substantially planar, relatively flexible element having a sharp chisel-like lead edge 40*a*. For example, the skive finger 40 may typically be made from a thin metal sheet. Of course, other strong, relatively flexible materials such as some plastic formulations are suitable for use with this invention. For assembly purposes, the skive finger 40 has an elongated slot 50 oriented in the longitudinal direction of the skive finger. The slot 50 has a cut-out portion 52 along one marginal edge which, in effect, forms a tab 52*a*.

The skive finger support 42 is formed as a main body portion 54 of molded plastic for example. The main body portion 54 includes a first ledge 56 and a second ledge 58 connected to a bridge 54*a* extending from the main body 54. The second ledge 58 is spaced from the first ledge 56 by a distance substantially equal to the thickness of the skive finger 40, and the bridge 54*a* has a width substantially equal to the width of the slot 50 of the skive finger 40. As such, the skive finger is readily receivable by the main body portion 54 of the support 42 by sliding the skive finger over the first ledge 56 and under the second ledge 58 to positively engage the opposed planar surfaces of a skive finger to capture the skive finger between the respective ledges.

A stop member 60 is provided on the main body portion 54 of the skive finger support 42. The stop member 60 serves to define the location of the skive finger relative to the main body portion 54 when the skive finger is slidably received on the first ledge 56. That is, upon sliding of the skive finger 40 onto the main body portion 54 of the support 42, the trail edge 40*b* of the skive finger 40 will engage the stop member 60 to limit the distance which the skive finger can slide on the ledge 56. As such, the support 42 captures a major segment of the skive finger 40, between the first ledge 56 and the second ledge 58, with the lead edge 40*a* of the skive finger extending beyond the main body portion 54. In this manner, the free portion of the skive finger 40 (that is, the portion of the finger which is able to flex) is significantly shortened. Consequently, the overall rigidity of the finger 40 is increased (i.e., flexibility is decreased).

The main body portion 54 of the skive finger support 42 also includes a locking feature 62. The locking feature 62 is formed as a ramp 62*a* located on the first ledge 56 between the second ledge 58 and the stop member 60. The ramp 62*a* extends progressively into the path of the skive finger 40 as the skive finger slides on the ledge 56 toward the stop member. The ramp 62*a* will thus cause a leg of the skive finger to flex upwardly as the skive finger slides onto the main body 54. Once the cut out 52 of the skive finger aligns with the locking feature 62, the flexed leg thereof will snap back to the unflexed state with the tab 52*a* positioned between the locking feature and the stop member 60. The vertical edge of the ramp 62 will then act on the tab 52*a* to retain the skive finger 40 on the support 42 by preventing the skive finger from being slidable in the direction opposite to the direction for receiving the skive finger on the support.

It is, of course, highly desirable that the skive finger 40 be readily removable from the skive finger support 42 to enable a worn or damaged skive finger to be easily replaced. In order for the skive finger 40 to be readily removable from the skive finger support 42, the main body portion 54 defines a release feature 64. The release feature 64 is a cut-out located beneath the tab 52*a* when the skive finger is retained in the support 42. Any suitable instrument can be selectively insert in the cut-out of the release feature 64 to lift the tab 52*a*, and thus the leg of the skive finger, above the ramp 62*a* of the locking feature 62. The skive finger 40 can then be readily pulled in the direction to readily remove the skive finger from the support 42.

Further, the main body portion 54 of the skive finger support 42 defines a slot 42*a* and a lead edge 42*b*. The slot 42*a* is adapted to be received on the shaft 34. Accordingly, each of the skive finger supports 42, and thus the respective skive fingers 40, is mounted on the shaft 34, to extend through an associated opening 36 in the bracket 32.

The longitudinal dimension of the main body portion of the skive finger supports 42 is preselected to normally locate the lead edge 40*a* of the respective skive fingers 40 in contact with the peripheral surface of the fuser roller 12 and the lead edge 42*a* of the respective supports 42 in spaced relation with the fuser roller (see FIG. 1). A tension spring 44 is connected between the main body portion of each of the skive finger supports 42 and the mounting bracket 32. The tension springs respectively urge the skive fingers 40 into engagement with the peripheral surface of the fuser roller 12 with sufficient force to establish a low attack angle, whereby a receiver member adhering to such roller will normally be stripped from the roller.

However, when the receiver member adheres to the fuser roller surface with sufficient force to overcome the stripping force of at least some of the skive fingers 40 of the skive mechanism 30, the skive fingers will be urged in a direction which pivots the associated skive finger supports 42 in a counter-clockwise direction (when viewed in the direction of FIG. 1). The preselected longitudinal dimension of the main body portion of the skive finger support 42 and the preselected location of the bracket 32, relative to the fuser roller 12, is such that, after a limited degree of pivotal movement, the lead edge 42*a* of the main body portion will contact the peripheral surface of the fuser roller (see FIG. 5). That is, the axes of the shaft 34 and the roller 12 are spaced apart a distance less than the longitudinal dimension of the main body portion of the skive finger support 42.

Due to the material from which the main body portion of the skive member support 42 is formed and the particular shape of the lead edge 42*a* thereof, contact of the main body portion lead edge with the fuser roller 12 will not damage the fuser roller peripheral surface. Additionally, limiting the pivotal movement of the skive members 38 prevents the skive fingers 40 from flexing to a degree which would cause the fingers to buckle and thereby assume a high attack angle with the fuser roller surface. Since a high attack angle represents a condition where gouging of the peripheral surface of the fuser roller (or damage to the skive fingers) occurs, it is clear that the particular construction of the skive mechanism 30 substantially prevents the fuser roller surface gouging, or skive finger damaging, condition to exist.

The invention has been described in detail with particular reference to preferred embodiment thereof, but it will be understood that variations and modifications can be effected within the spirit and scope of the invention as set forth in the claims.

What is claimed is:

1. In a skive mechanism for stripping a receiver member adhering to a riser assembly roller, said skive mechanism including at least one simplified skive member comprising:

an elongated, substantially planar, relatively flexible skive finger, said skive finger defining an elongated slot oriented in the longitudinal direction of said skive finger, and a tab, formed at one end edge of said slot extending transverse to the direction of said slot in the plane of said skive finger; and a support body for readily releasably receiving said skive finger to support a major portion of said skive finger so as to decrease the flexibility thereof, said support body having a first ledge upon which a skive finger can be slidably received, a second ledge opposed said first ledge and spaced therefrom a distance so as to positively engage the opposed planar surfaces of a skive finger to capture such skive finger therebetween, and a stop member positioned transverse to said slot to limit the distance to which the skive finger can slide along said first ledge in the direction of said slot.

2. The simplified skive member according to claim 1 wherein said support body further includes a locking feature adapted to be associated with said tab of said skive finger for preventing said skive finger, after engagement with said stop member, from moving in a direction opposite such sliding direction.

3. The simplified skive member according to claim 2 wherein said support body further includes a release feature located in association with said tab of said skive finger when said skive finger is received by said support body in engagement with said stop member for enabling said skive finger to be selectively released from said locking feature to permit movement in a direction opposite the sliding direction.

4. A skive mechanism for stripping a receiver member adhering to a fuser assembly roller, said skive mechanism comprising:

a plurality of elongated, substantially planar, relatively flexible skive fingers, said skive fingers respectively defining an elongated slot oriented in the longitudinal direction of said skive finger, and a tab, formed at one end edge of said slot extending transverse to the direction of said slot in the plane of said skive finger;

a plurality of support bodies, associated with said plurality of skive fingers respectively, for readily releasably receiving said skive fingers to support a major portion of each of said skive fingers so as to decrease the flexibility thereof, said support bodies respectively having a first ledge upon which a skive finger can be slidably received, a second ledge opposed said first ledge and spaced therefrom a distance so as to positively engage the opposed planar surfaces of a skive finger to capture such skive finger therebetween, and a stop member positioned transverse to said slot to limit the distance to which the skive finger can slide along said first ledge in the direction of said slot; and means for mounting said skive finger supporting means, relative to a fuser assembly roller.

5. The skive mechanism according to claim 4 wherein each of said support bodies further includes a locking feature adapted to be associated with a respective tab of said skive finger for preventing said skive finger from moving in a direction opposite the sliding direction.

6. The skive mechanism according to claim 5 wherein each of said receiving means support bodies further includes a release feature located in association with said tab of said skive finger when said skive finger is received by said support body in engagement with said stop member for enabling said skive finger to be selectively released from said locking feature to permit movement in a direction opposite the sliding direction.

* * * * *